US009349312B2

(12) United States Patent
Hwang et al.

(10) Patent No.: US 9,349,312 B2
(45) Date of Patent: May 24, 2016

(54) AMOLED DISPLAY DEVICE AND METHOD FOR PRECISELY COMPENSATING AGING THEREOF

(71) Applicant: Shenzhen China Star Optoelectronics Technology Co., LTD., Shenzhen, Guangdong Province (CN)

(72) Inventors: Taijiun Hwang, Shenzhen (CN); Yuanchun Wu, Shenzhen (CN)

(73) Assignee: SHENZHEN CHINA STAR OPTOELECTRONICS TECHNOLOGY CO., LTD., Shenzhen, Guangdong Province (CN)

( * ) Notice: Subject to any disclaimer, the term of this patent is extended or adjusted under 35 U.S.C. 154(b) by 354 days.

(21) Appl. No.: 13/807,714

(22) PCT Filed: Nov. 2, 2012

(86) PCT No.: PCT/CN2012/083944
§ 371 (c)(1),
(2) Date: Dec. 28, 2012

(87) PCT Pub. No.: WO2014/063384
PCT Pub. Date: May 1, 2014

(65) Prior Publication Data

US 2014/0267444 A1 Sep. 18, 2014

(30) Foreign Application Priority Data

Oct. 22, 2012 (CN) ..... 2012 1 0404875

(51) Int. Cl.

| | |
|---|---|
| ***G09G 5/10*** | (2006.01) |
| ***G09G 3/36*** | (2006.01) |
| ***G09G 3/10*** | (2006.01) |
| ***G09G 3/32*** | (2006.01) |
| ***G09G 3/20*** | (2006.01) |

(52) U.S. Cl.
CPC ..... *G09G 3/3225* (2013.01); *G09G 3/2025* (2013.01); *G09G 2340/06* (2013.01)

(58) Field of Classification Search
CPC ..... G09G 2320/0233; G09G 3/3208; G09G 2360/16
USPC ..... 345/76–78, 690
See application file for complete search history.

(56) References Cited

U.S. PATENT DOCUMENTS

| | | | | |
|---|---|---|---|---|
| 2006/0033445 | A1* | 2/2006 | Kim et al. | 315/169.3 |
| 2007/0091042 | A1* | 4/2007 | Chung et al. | 345/88 |

(Continued)

FOREIGN PATENT DOCUMENTS

| | | | |
|---|---|---|---|
| CN | 101044541 | A | 9/2007 |
| CN | 101194300 | A | 6/2008 |
| CN | 100483488 | C | 4/2009 |

(Continued)

*Primary Examiner* — Amit Chatly
(74) *Attorney, Agent, or Firm* — Cheng-Ju Chiang

(57) ABSTRACT

The present invention relates to an AMOLED display device, which includes a display panel; a data processor, which processes image data from a video source and compensation data from a compensation unit and outputs compensated image data, the image data having a first color depth, the compensation data and the compensated image data having a second color depth that is greater than the first color depth; a frame rate control module, which adjusts the compensated image data to the first color depth; a timing controller, which generates a timing control signal; a driver, which drives the display panel; a display measurement module, which measures homogeneity of displaying of the display panel; and a compensation unit, which generates compensation data of second color depth. The present invention also provides a method for precisely compensating an AMOLED display device.

11 Claims, 4 Drawing Sheets

(56) References Cited

U.S. PATENT DOCUMENTS

| | | | | |
|---|---|---|---|---|
| 2008/0238911 | A1 | 10/2008 | Chung et al. | |
| 2012/0032991 | A1 * | 2/2012 | Cha et al. | 345/690 |

FOREIGN PATENT DOCUMENTS

| | | | |
|---|---|---|---|
| CN | 1886774 | B | 8/2010 |
| JP | 2006-303630 | A | 11/2006 |

* cited by examiner

AMOLED DISPLAY DEVICE AND METHOD FOR PRECISELY COMPENSATING AGING THEREOF

BACKGROUND OF THE INVENTION

1. Field of the Invention

The present invention relates to AMOLED displaying techniques, and in particular to an AMOLED display device and method for precisely compensating aging thereof.

2. The Related Arts

AMOLED (Active Matrix Organic Light-Emitting Diode) panel shows various advantages, such as high response speed, high contrast, ad wide view angle, as compared to a traditional liquid crystal panel.

AMOLED is a type of OLED (Organic Light-Emitting Diode). Light emission of OLED is realized through electroluminescence caused by injection and recombination of carriers of organic semiconductor material and light emissive material under an electric field. The principle of emitting light of OLED is that an ITO (Indium Tin oxide) transparent electrode and a metal electrode are used as anode and cathode of a device and, being driven by an electric field, electrons and electronic holes are respectively injected into electron and hole transportation layers from cathode and anode. The electrons and the holes migrate through the electron and hole transportation layers to a light emissive layer and meet each other in the light emissive layer to form excitons that excite light-emissive molecules, while the later gives off visible light due to radiative relaxation. The radiating light can be observed at one side of the ITO. The metal electrode layer also serves as a reflection layer.

Compared to a TFT-LCD (Thin-Film Transistor Liquid Crystal Display), an OLED has various advantages, such as being thinner and lighter, active emission of light (requiring no backlighting), being free of view angle issue, high sharpness, high brightness, fast response, low power consumption, wide range of operation temperature, excellent resistance to vibration, low cost, being capable of flexible displaying, of which some are not possible with TFT liquid crystal panel.

However, the AMOLED display uses electrical current flowing through organic material film to give off light. Different organic materials give off light of different colors. With the use of an AMOLED display, the organic material contained in the device may get aging and the light emission efficiency becomes low thereby shortening the lifespan of the display. Different organic materials may age with different speeds thereby leading to different extents of color aging. Further, white field of a display may vary with the use of the display. Further, each pixel may get aging in different speed from those of the other pixels, leading inhomogeneous displaying. Thus, an AMOLED display device must have certain compensation measures to maintain the characteristics thereof.

Referring to FIG. 1, a schematic view is given to illustrate the structure of a conventional AMOLED display device that includes aging compensation function. The AMOLED display device comprises a display panel 11, which comprises AMOLED based pixels; a data processor 12, which processes image data from a video source and compensation data from a compensation unit 16 and outputs compensated image data; a timing controller (TCON) 13, which generates a timing control signal according to the output from the data processor 12; a driver 14, which drives the display panel 11 according to the timing control signal; a display measurement module 15, which measures homogeneity of displaying of the display panel 11; a compensation unit 16, which generates and transmits compensation data according to the measurement result from the display measurement module 15 to the data processor 12. For details of achieving the functions of the compensation unit 16 and the display measurement module 15, reference is made to disclosures of Chinese Patent Application No. CN101194300A and Chinese Patent No. CN1886774B.

Image data of 8-bit color depth from a video source are transmitted to the data processor 12 and the image data of 8-bit color depth processed by the data processor 12 are transmitted to the timing controller 13. The primary function of the timing controller 13 is providing necessary timing control signals to a source driver and a gate driver. The timing sequence of the timing controller 13 is determined by the data structure and displaying mode of the image data. The timing control signal that contains the 8-bit color depth information is transmitted to the driver 14. The driver 14 is generally composed of the source driver and the gate driver. The driver 14 drives the display panel 11 according to the 8-bit color depth and converts it into an electrical current to drive OLEDs of the display panel 11 to give off visible light. Since the aging phenomenon of the AMOLED display device varies with time, the displayed result required by the image data will be different from the actual result of displaying of the display panel 11, leading to inhomogeneous displaying. Consequently, aging compensation may be carried out on the OLEDs. The display measurement module 15 is used to measure the displaying homogeneity of the display panel 11 and then the compensation unit 16 generates 8-bit color depth compensation data. The compensation data are transmitted to the data processor 12 to be processed and mixed in combination with the image data in order to effect compensation of the image data. The compensated 8-bit color depth image data are then transmitted to the timing controller 13 and then applied to the driver 14 to drive the display panel.

However, according to the aging compensation carried out with the conventional ways, the compensation that an integrated circuit (IC) of the driver must be done by at least one level and after conversion into electrical current, the difference of current between two adjacent levels is significant, making it not possible to make precise compensation. A specific condition can be seen from FIG. 2, which illustrates Ids-Vgs characteristic curve of the integrated circuit that drives OLEDs for Vds being equal to −10V and −0.1V. It can be found from FIG. 2 that although the values of Vds may be close, yet the values of Ids are greatly different.

On the other hand, the result of displaying of liquid crystal is determined by the effective voltage applied to the liquid crystal. The gray scale (color) of liquid crystal can be achieved in two ways, namely PWM (Pulse Width Modulation) and FRC (Frame Rate Control). The PWM way divides a scanning time period into a plurality of time slices. For example, for 256 level grey scaling, the division is made for 256 time slices. The number of time slices that are applied with a drive voltage is determined by the grey level to be achieved.

Referring to FIG. 3, a schematic view is given to illustrate the principle of the conventional FRC technique. The FRC technique is a technique that controls frame rate to visually increase the number of colors by applying the phenomenon of persistence of vision of human eyes. FRC uses time average method to make human eyes perceiving different levels of brightness. FRC is similar to PWM but with time slice replaced by frame. As shown in FIG. 3, four time slices correspond respectively to the first frame, the second frame, the third frame, and the fourth frame. For liquid crystal, being of a drive voltage means displaying black. Different visual gray levels can be observed with the persistence of vision based on an arrangement of four successive time slices to which the frames correspond being of driving voltages or not. The way of expressing colors with liquid crystal is similar to that for achieving grey scale and is actually modulation of the grey scales for three primary colors of red, green, and blue.

SUMMARY OF THE INVENTION

Thus, an object of the present invention is to provide an AMOLED display device that improves preciseness of compensation for aging compensation of OLEDs.

Another object of the present invention is to provide a method for precisely compensating aging of an AMOLED display device.

To achieve the objects, the present invention provides an AMOLED display device, which comprises:

a display panel, which comprises AMOLED based pixels;

a data processor, which processes image data from a video source and compensation data from a compensation unit and outputs compensated image data, the image data having a first color depth, the compensation data and the compensated image data having a second color depth that is greater than the first color depth;

a frame rate control module, which adjusts the compensated image data to the first color depth;

a timing controller, which generates a timing control signal according to an output from the frame rate control module;

a driver, which drives the display panel according to the timing control signal;

a display measurement module, which measures homogeneity of displaying of the display panel; and a compensation unit, which generates and transmits compensation data of second color depth according the measurement result of the display measurement module to the data processor.

Wherein, the first color depth is 8 bits.

Wherein, the second color depth is 10 bits.

Wherein, the compensation unit comprises a look-up table.

Wherein, the display panel supports the first color depth.

The present invention also provides a method for precisely compensating an AMOLED display device, which comprises:

(1) the data processor processing image data from a video source and compensation data from a compensation unit and outputting compensated image data, the image data having a first color depth, the compensation data and the compensated image data having a second color depth that is greater than the first color depth;

(2) the frame rate control module adjusting the compensated image data to the first color depth;

(3) the timing controller generating a timing control signal according to an output from the frame rate control module;

(4) the driver driving a display panel that comprises AMOLED based pixels according to the timing control signal;

(5) the display measurement module measuring homogeneity of displaying of the display panel the display panel; and (6) the compensation unit generating and transmitting compensation data of second color depth according the measurement result of the display measurement module to the data processor.

Wherein, the first color depth is 8 bits.

Wherein, the second color depth is 10 bits.

Wherein, the compensation unit comprises a look-up table.

Wherein, the display panel supports the first color depth.

The present invention further provides an AMOLED display device, which comprises:

a display panel, which comprises AMOLED based pixels;

a data processor, which processes image data from a video source and compensation data from a compensation unit and outputs compensated image data, the image data having a first color depth, the compensation data and the compensated image data having a second color depth that is greater than the first color depth;

a frame rate control module, which adjusts the compensated image data to the first color depth;

a timing controller, which generates a timing control signal according to an output from the frame rate control module;

a driver, which drives the display panel according to the timing control signal;

a display measurement module, which measures homogeneity of displaying of the display panel; and a compensation unit, which generates and transmits compensation data of second color depth according the measurement result of the display measurement module to the data processor; and wherein the first color depth is 8 bits;

wherein the second color depth is 10 bits;

wherein the compensation unit comprises a look-up table; and wherein the display panel supports the first color depth The present invention provides an AMOLED display device that improves preciseness of compensation for aging compensation of OLEDs. The present invention provides a method for precisely compensating aging of an AMOLED display device that improves the preciseness of compensating AMOLED display device.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

Figure 1:
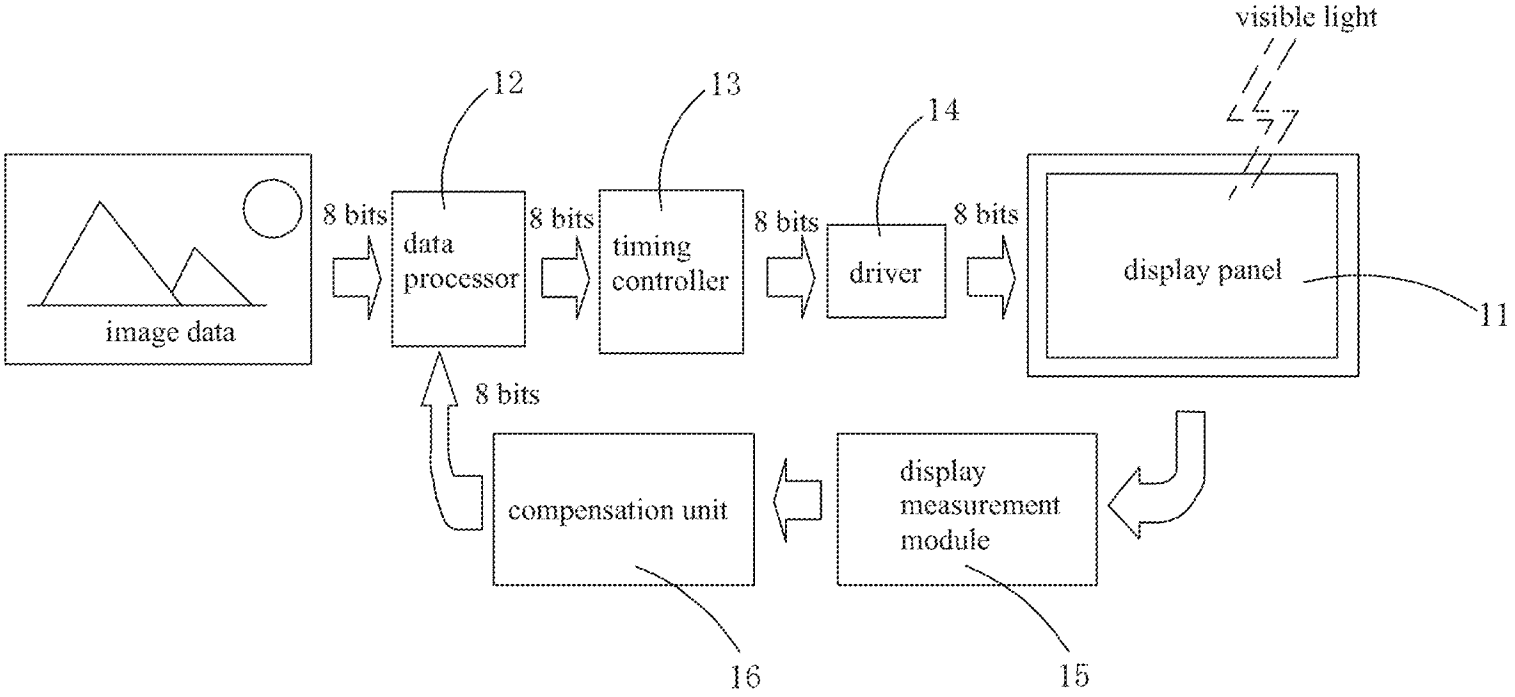
Fig. 1 (Prior Art)
FIG. 1 is a schematic view illustrating the structure of a conventional AMOLED display device that includes aging compensation function.
Figure 2:
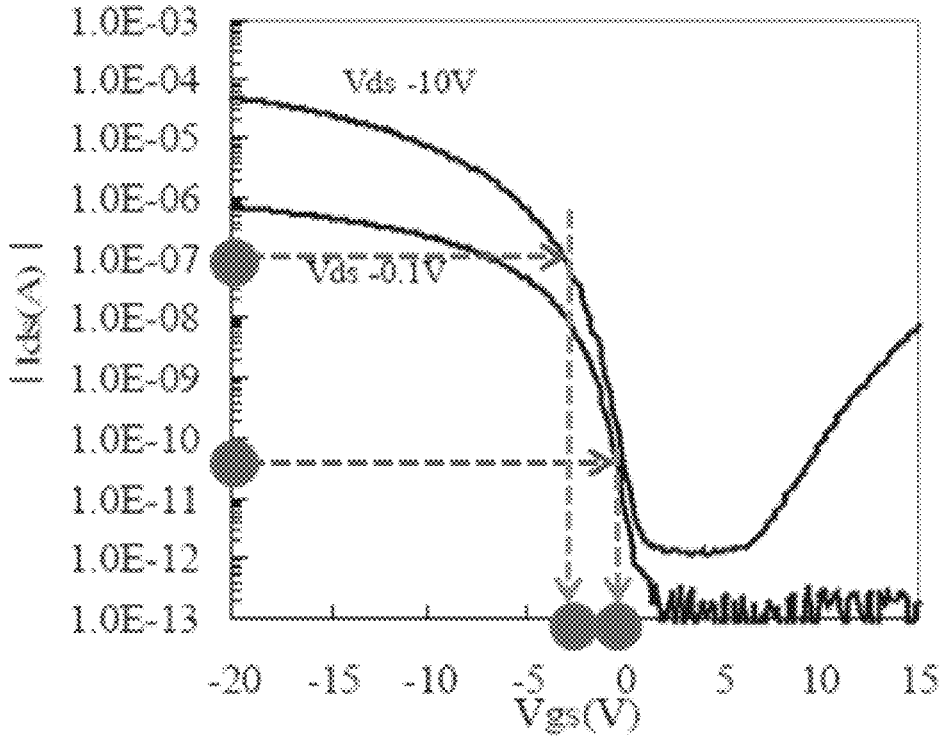
Fig. 2 (Prior Art)
FIG. 2 illustrates Ids-Vgs characteristic curve of an integrated circuit that drives OLEDs for Vds being equal to −10V and −0.1V.
Figure 3:
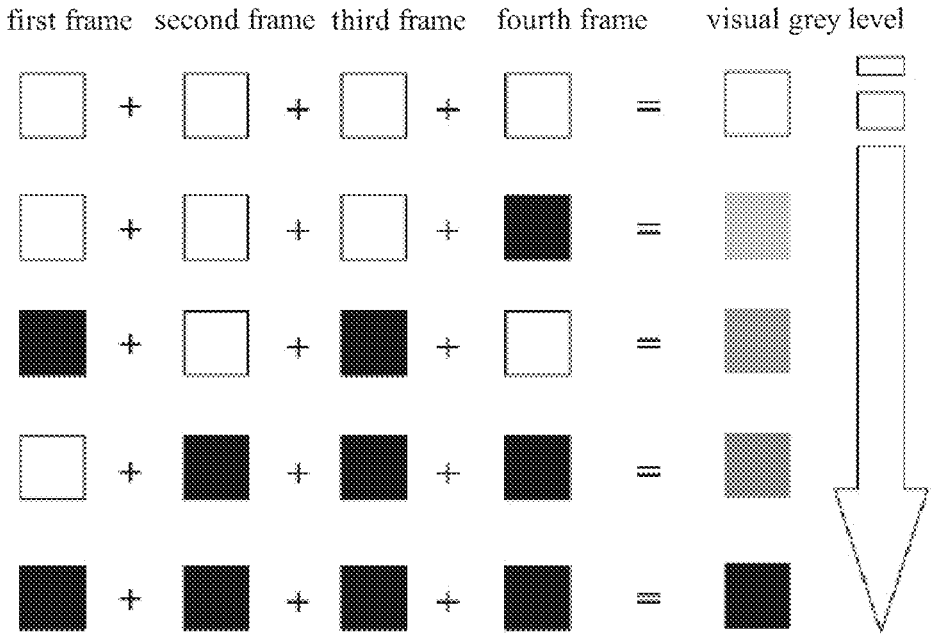
Fig. 3 (Prior Art)
FIG. 3 is a schematic view illustrating the principle of the conventional FRC technique.
Figure 4:
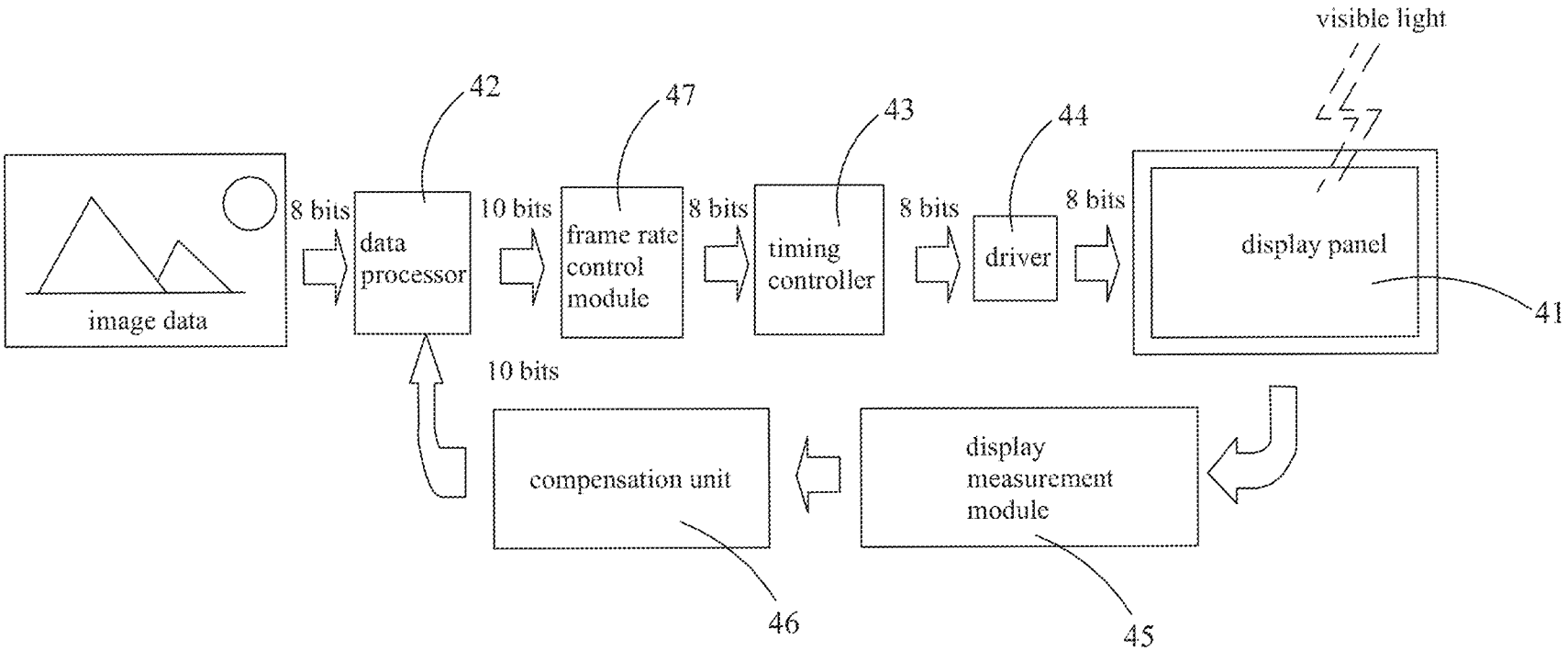
FIG. 4 is a schematic view illustrating the structure of an AMOLED display device according to a preferred embodiment of the present invention.

Referring to FIG. 4, which is a schematic view illustrating the structure of an AMOLED (Active Matrix Organic Light-Emitting Diode) display device according to a preferred embodiment of the present invention, the AMOLED display device generally comprises a display panel 41, which comprises AMOLED based pixels; a data processor 42, which processes image data from a video source and compensation data from a compensation unit 46 and outputs compensated image data, the image data having a first color depth, the compensation data and the compensated image data having a second color depth that is greater than the first color depth; a frame rate control module 47, which adjusts the compensated image data to the first color depth; a timing controller 43, which generates a timing control signal according to an output from the frame rate control module 47; a driver 44, which drives the display panel 41 according to the timing control signal; a display measurement module 45, which measures homogeneity of displaying of the display panel 41; a compensation unit 46, which generates and transmits compensation data of second color depth according the measurement result of the display measurement module 45 to the data processor 42.

Image data of 8-bit color depth from a video source are transmitted to the data processor 42. The data processor 42 processes the 8-bit color depth image data from the video source and the 10-bit color depth compensation data from the compensation unit 46 and outputs 10-bit color depth compensated image data. The frame rate control module 47 adjusts the 10-bit color depth compensated image data into 8-bit color depth for transmission to the timing controller 43. The timing control signal that contains the 8-bit color depth information is transmitted to the driver 44. The driver 44 drives an OLED of the display panel 41 to give off visible light according to the 8-bit color depth timing control signal. To provide a compensation circuit, the display measurement module 45 measures the homogeneity of displaying of the display panel 41 and then the compensation unit 46 generates 10-bit color depth compensation data. The compensation data are transmitted to the data processor 42 to be processed and mixed in combination with the image data in order to have the result of displaying required by the image data consistent with actual result of displaying provided by the display panel 41, thereby making displaying homogeneous.

Similar to the way of achieving grey scaling (color) of liquid crystal, the result of displaying of the AMOLED display device can be adjusted through an FRC way. The present invention modifies the aging compensation data to increase the color depth thereof, namely the color depth being increased from 8 bits to 10 bits, because the number of bit of color depth receivable by the display panel is fewer. Thus, using the FRC way can allow the displaying result to show higher color depth data, by which the preciseness of compensation is improved.

The present invention requires the condition that the second color depth is greater than the first color depth to be satisfied. In addition to the first color depth being of 8 bit and the second color depth being of 10 bits, other suitable arrangements are also available. The display panel 41 is preferably arranged to exactly support the first color depth. A display panel 41 that is smaller than the first color depth cannot support normal displaying of image data and a display panel 41 that is greater than the first color depth heightens the cost. Further, a display panel 41 that is greater than or equal to second color depth does not need to use the frame rate control module 47. The compensation unit 46 may comprise a look-up table to support the generation of compensation data of second color depth.

Figure 5:
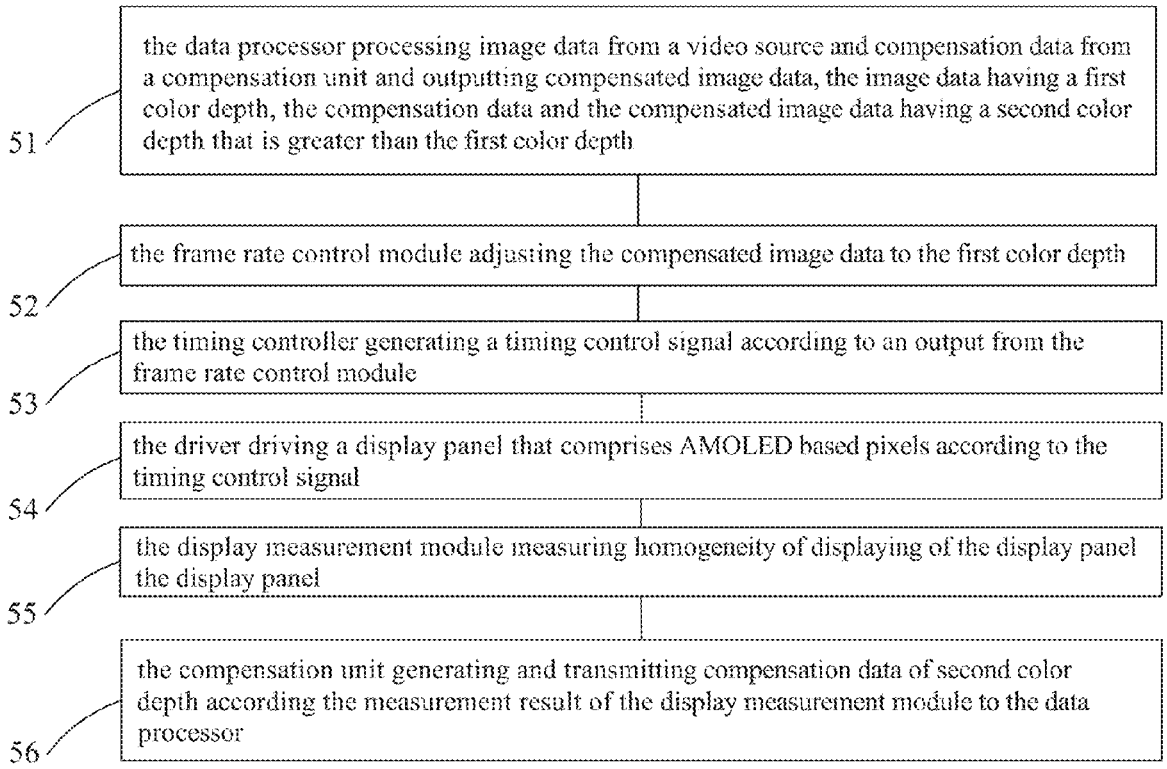
FIG. 5 is a flow chart illustrating a method for precisely compensating aging of an AMOLED display device according to the present invention.

Referring to FIG. 5, which is a flow chart illustrating a method for precisely compensating aging of an AMOLED display device according to the present invention, the method comprises:

Step 51: the data processor processing image data from a video source and compensation data from a compensation unit and outputting compensated image data, the image data having a first color depth, the compensation data and the compensated image data having a second color depth that is greater than the first color depth;

Step 52: the frame rate control module adjusting the compensated image data to the first color depth;

Step 53: the timing controller generating a timing control signal according to an output from the frame rate control module;

Step 54: the driver driving a display panel that comprises AMOLED based pixels according to the timing control signal;

Step 55: the display measurement module measuring homogeneity of displaying of the display panel the display panel; and Step 56: the compensation unit generating and transmitting compensation data of second color depth according the measurement result of the display measurement module to the data processor.

The first color depth is 8 bits and the second color depth is 10 bits. The display panel supports the first color depth. The compensation unit may comprise a look-up table to support the generation of compensation data of second color depth.

In summary, the present invention provides an AMOLED display device that improves preciseness of compensation for aging compensation of OLEDs. The present invention provides a method for precisely compensating aging of an AMOLED display device that improves the preciseness of compensating AMOLED display device.

Based on the description given above, those having ordinary skills of the art may easily contemplate various changes and modifications of the technical solution and technical ideas of the present invention and all these changes and modifications are considered within the protection scope of right for the present invention.

What is claimed is:

1. An AMOLED (Active Matrix Organic Light-Emitting Diode) display device adapted to receive an input of a video source that comprises image data representing an ideal displaying effect and having a first color depth and feeds the image data through a data processor, a frame rate control module, a timing controller, and a driver that drives the display panel so as to have the image data on a display panel with an actual displaying effect, wherein the display panel comprises AMOLED based pixels that age differently to lead to inconsistent displaying homogeneity of the image data on the display panel so that the actual displaying effect is deviated from the ideal displaying effect, the display device further comprising an assembly built in the display device to measure the displaying homogeneity of the display panel and supply a measurement result to the data process, wherein the assembly comprises:

a display measurement module that measures the displaying homogeneity of the display panel to provide the measurement result; and a compensation unit that receives the measurement result and, in response, generates and transmits compensation data to the data processor, the compensation data being of a second color depth that is different from the first color depth;

wherein the data processor receives and processes the image data from the video source and the compensation data from the compensation unit and outputs compensated image data, which is of the second color depth;

the frame rate control module adjusts the compensated image data to the first color depth;

the timing controller generates a timing control signal according to an output from the frame rate control module;

the driver drives the display panel according to the timing control signal so as to display a compensated displaying effect that reduces inconsistency of the displaying homogeneity;

wherein the compensation data of the second color depth involving the measurement result of the displaying homogeneity of the display panel is directly supplied to the data processor to generate the compensated image data.

2. The AMOLED display device as claimed in claim 1, wherein the first color depth is 8 bits.

3. The AMOLED display device as claimed in claim 1, wherein the second color depth is 10 bits.

4. The AMOLED display device as claimed in claim 1, wherein the compensation unit comprises a look-up table.

5. The AMOLED display device as claimed in claim 1, wherein the display panel supports the first color depth.

6. A method for precisely compensating an Active Matrix Organic Light-Emitting Diode (AMOLED) display device, comprising:

(1) a data processor receiving and processing image data supplied from a video source and representing an ideal displaying effect, the image data being fed through a frame rate control module, a timing controller, and a driver that drives a display panel that comprises AMOLED based pixels that age differently to display the image data with an actual displaying effect that is deviated from the ideal displaying effect due to different levels of aging of the AMOLED based pixels of the AMOLED display device that lead to inconsistent displaying homogeneity of the display panel, and the data processor also receiving and processing compensation data from an assembly that comprises a display measurement module and a compensation unit and is built in the AMOLED display device and outputting compensated image data, the image data having a first color depth, the compensation data and the compensated image data having a second color depth that is greater than the first color depth;

(2) the frame rate control module adjusting the compensated image data to the first color depth;

(3) the timing controller generating a timing control signal according to an output from the frame rate control module;

(4) the driver driving the display panel according to the timing control signal so as to display a compensated displaying effect that reduces inconsistency of the displaying homogeneity;

(5) the display measurement module of the assembly that is built in the AMOLED display device measuring the displaying homogeneity of the display panel and providing a measurement result; and (6) the compensation unit of the assembly that is built in the AMOLED display device generating and transmitting the compensation data of the second color depth according to the measurement result of the display measurement module to the data processor, wherein the compensation data of the second color depth involving the measurement result of the displaying homogeneity of the display panel is directly supplied to the data processor to generate the compensated image data.

7. The method for precisely compensating an AMOLED display device as claimed in claim 6, wherein the first color depth is 8 bits.

8. The method for precisely compensating an AMOLED display device as claimed in claim 6, wherein the second color depth is 10 bits.

9. The method for precisely compensating an AMOLED display device as claimed in claim 6, wherein the compensation unit comprises a look-up table.

10. The method for precisely compensating an AMOLED display device as claimed in claim 6, wherein the display panel supports the first color depth.

11. An AMOLED (Active Matrix Organic Light-Emitting Diode) display device adapted to receive an input of a video source that comprises image data representing an ideal displaying effect and having a first color depth and feeds the image data through a data processor, a frame rate control module, a timing controller, and a driver that drives the display panel so as to have the image data on a display panel with an actual displaying effect, wherein the display panel comprises AMOLED based pixels that age differently to lead to inconsistent displaying homogeneity of the image data on the display panel so that the actual displaying effect is deviated from the ideal displaying effect, the display device further comprising an assembly built in the display device to measure the displaying homogeneity of the display panel and supply a measurement result to the data process, wherein the assembly comprises:

a display measurement module that measures the displaying homogeneity of the display panel to provide the measurement result; and a compensation unit that receives the measurement result and, in response, generates and transmits compensation data to the data processor, the compensation data being of a second color depth that is different from the first color depth;

wherein the data processor receives and processes the image data from the video source and the compensation data from the compensation unit and outputs compensated image data, which is of the second color depth;

the frame rate control module adjusts the compensated image data to the first color depth;

the timing controller generates a timing control signal according to an output from the frame rate control module;

the driver drives the display panel according to the timing control signal so as to display a compensated displaying effect that reduces inconsistency of the displaying homogeneity;

wherein the compensation data of the second color depth involving the measurement result of the displaying homogeneity of the display panel is directly supplied to the data processor to generate the compensated image data;

wherein the first color depth is 8 bits;

wherein the second color depth is 10 bits;

wherein the compensation unit comprises a look-up table; and wherein the display panel supports the first color depth.

* * * * *